US010874145B2

(12) United States Patent
Schiff et al.

(10) Patent No.: US 10,874,145 B2
(45) Date of Patent: Dec. 29, 2020

(54) ELECTRONIC SMOKING ARTICLE

(71) Applicant: Altria Client Services LLC, Richmond, VA (US)

(72) Inventors: David R. Schiff, Highland Park, VA (US); Chris Phelan, Richmond, VA (US); Eric Hawes, Glen Allen, VA (US); Berina Yerkic-Husejnovic, Richmond, VA (US); Christopher S. Tucker, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 255 days.

(21) Appl. No.: 16/040,906

(22) Filed: Jul. 20, 2018

(65) Prior Publication Data

US 2018/0325180 A1 Nov. 15, 2018

Related U.S. Application Data

(63) Continuation of application No. 14/498,175, filed on Sep. 26, 2014, now Pat. No. 10,039,322.
(Continued)

(51) Int. Cl.
*A24F 40/40* (2020.01)
*A24F 47/00* (2020.01)

(52) U.S. Cl.
CPC ..... *A24F 47/008* (2013.01)

(58) Field of Classification Search
None
See application file for complete search history.

(56) References Cited

U.S. PATENT DOCUMENTS 4,517,996 A * 5/1985 Vester ..... A24D 3/043 131/339
2008/0136369 A1* 6/2008 Klemenz ..... H04R 25/55 320/107
(Continued)

FOREIGN PATENT DOCUMENTS

CN 101390659 A 3/2009
CN 201226775 Y 4/2009
(Continued)

OTHER PUBLICATIONS

International Search Report for corresponding patent application No. PCT/US2014/057764, dated Jan. 27, 2015.
(Continued)

*Primary Examiner* — Paul S Hyun
(74) *Attorney, Agent, or Firm* — Harness, Dickey & Pierce, P.L.C.

(57) ABSTRACT

An electronic smoking article includes an outer housing extending in the longitudinal direction, a liquid aerosol formulation, a heater operable to at least partially volatilize at least a portion of the liquid aerosol formulation and form an aerosol, a power supply operable to apply voltage across the heater, at least one light emitting diode, a charging button assembly including a conductive post operable to form a first external, electrical contact at the upstream end of the electronic smoking article, and a second external, electrical contact including a portion of an outer surface of the outer housing at the upstream end of the electronic smoking article. The first and second external, electrical contacts charge the power supply.

18 Claims, 6 Drawing Sheets

Related U.S. Application Data

(60) Provisional application No. 61/883,742, filed on Sep. 27, 2013.

(56) References Cited

U.S. PATENT DOCUMENTS

| | | | |
|---|---|---|---|
| 2010/0200008 | A1 | 8/2010 | Taieb |
| 2011/0011396 | A1 | 1/2011 | Fang |
| 2011/0265806 | A1 | 11/2011 | Alarcon et al. |
| 2011/0304282 | A1 | 12/2011 | Li et al. |
| 2012/0118307 | A1 | 5/2012 | Tu |
| 2012/0199146 | A1 | 8/2012 | Marangos |
| 2014/0014124 | A1 | 1/2014 | Glasberg et al. |

FOREIGN PATENT DOCUMENTS

| | | | |
|---|---|---|---|
| CN | 101606758 | A | 12/2009 |
| CN | 201830899 | U | 5/2011 |
| CN | 102970885 | A | 3/2013 |
| WO | WO-2013040193 | A2 | 3/2013 |

OTHER PUBLICATIONS

Official Notification dated Jul. 20, 2017 for corresponding EA Application No. 201690665. (provided with English translation).
Office Action for corresponding Eurasian Application No. 201690665 dated Dec. 26, 2017 and English translation thereof.
Office Action for corresponding Chinese Application No. 201480053388.X dated Feb. 14, 2018 and English translation thereof.
Notice of Examination for corresponding Pakistan Application No. 675/2014.

* cited by examiner

ELECTRONIC SMOKING ARTICLE

CROSS REFERENCE TO RELATED APPLICATIONS

This is a continuation under 35 U.S.C. § 120 of U.S. application Ser. No. 14/498,175, filed Sep. 26, 2014, which claims priority under 35 U.S.C. § 119(e) to U.S. Provisional Application No. 61/883,742, filed on Sep. 27, 2013, the entire contents of each of which are incorporated herein by reference.

BACKGROUND

Many of the embodiments disclosed herein include electronic smoking articles operable to deliver liquid from a liquid supply source (reservoir) to a heater. The heater volatilizes a liquid to form an aerosol.

SUMMARY

An electronic smoking article includes an outer housing extending in the longitudinal direction, a liquid aerosol formulation, a heater operable to at least partially volatilize the liquid aerosol formulation and form an aerosol, a power supply operable to apply voltage across the heater, at least one LED, a charging button assembly including a conductive post operable to form a first external, electrical contact at the upstream end of the electronic smoking article, the conductive post being partially surrounded by a charging button housing that is retained in the upstream end of the electronic smoking article, the charging button assembly operable to be pushed so as to illuminate the at least one LED, and a second external, electrical contact including a portion of an outer surface of the outer housing at the upstream end of the electronic smoking article.

DETAILED DESCRIPTION

An electronic smoking article includes two external, electrical contacts at an upstream end of the electronic smoking article. The two external, electrical contacts allow for recharging of a power supply without the need for disassembling the electronic smoking article. The first electrical contact includes a charging button assembly at the upstream end of the electronic smoking article. The second electrical contact is formed by an upstream end surface of an outer housing of the electronic smoking article. The electronic smoking article can be at least partially inserted into a charger to recharge the power supply.

As used herein, the term "electronic smoking article" is inclusive of all types of electronic smoking articles, regardless of form, size or shape, including electronic cigarettes, electronic cigars, electronic pipes, electronic hookahs and the like. The liquid aerosol formulation can include nicotine or be nicotine free. Moreover, the liquid aerosol formulation can include tobacco flavors or instead, or in combination include other suitable flavors.

Figure 1:
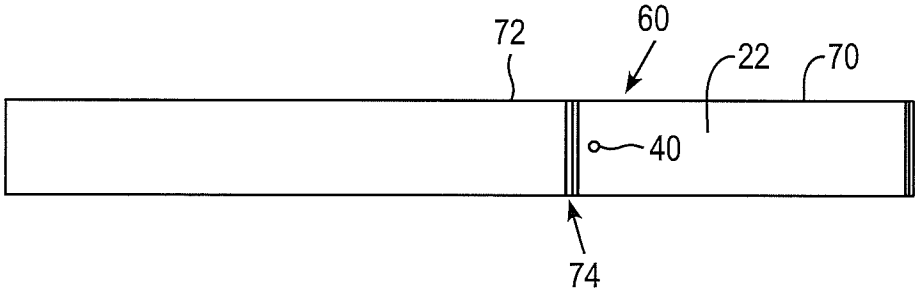
FIG. 1 is a side view of an electronic smoking article constructed according to the teachings herein.
Figure 2:
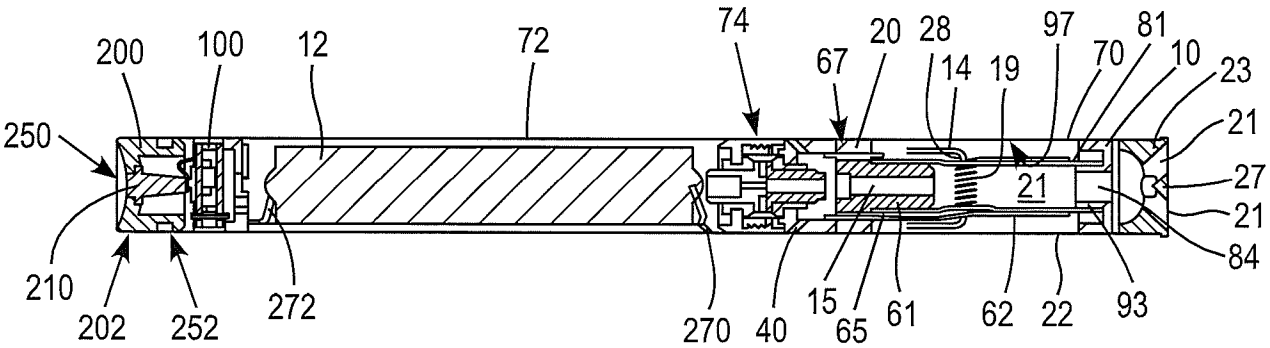
FIG. 2 is a cross-sectional view of an electronic smoking article according to a first embodiment.

Preferably, as shown in FIGS. 1 and 2, the electronic smoking article 60 comprises a first section 70 and a second section 72, which are coupled together at a threaded joint 74 or by other convenience such as a snug-fit, snap-fit, detent, clamp and/or clasp.

As shown in FIG. 2, the first section 70 can house a mouth-end insert 27, a heater 19, a liquid supply (reservoir) 14 and a filamentary wick 28. The second section 72 can house a power supply 12, a puff sensor and feedback assembly 100, and a charging button assembly 200. Preferably, the charging button assembly 200 is located at an upstream end 202 of the electronic smoking article 60 and forms a first electrical contact 250. A second electrical contact 252 may be formed by an outer surface portion of an outer housing 22 adjacent an upstream end 202 of the housing 22.

Preferably, the first section 70 and the second section 72 include the outer housing 22 extending in a longitudinal direction along a length of the electronic smoking article 60. In another embodiment, the outer housing 22 may comprise a single, unitary tube.

As shown in FIG. 2, the first section 70 includes the outer housing (or tube or casing) 22 extending in a longitudinal direction and an inner tube (or chimney) 62 coaxially positioned within the outer tube 22. Preferably, a nose portion 61 of an upstream gasket (or seal) 20 is fitted into an upstream end portion 65 of the inner tube 62, while at the same time, an outer perimeter 67 of the gasket 20 provides a liquid-tight seal with an interior surface 97 of the outer housing 22. The upstream gasket 20 also includes a central, longitudinal air passage 15, which opens into an interior of the inner tube 62 that defines a central channel 21.

Preferably, a nose portion 93 of a downstream gasket 10 is fitted into a downstream end portion 81 of the inner tube 62. An outer perimeter of the gasket 10 provides a substantially liquid-tight seal with an interior surface 97 of the outer housing 22. The downstream gasket 10 includes a central channel 84 disposed between the central passage 21 of the inner tube 62 and the mouth-end insert 27.

In this embodiment, the reservoir 14 is contained in an annulus between an inner tube 62 and an outer housing 22 and between the upstream gasket 20 and the downstream gasket 10. Thus, the reservoir 14 at least partially surrounds the central air passage 21. The reservoir 14 comprises a liquid aerosol formulation and optionally a liquid storage medium (not shown) operable to store the liquid aerosol formulation therein.

The inner tube 62 has a central air passage 21 extending therethrough, which houses the heater 19. The heater 19 is in contact with the filamentary wick 28, which preferably extends between opposing sections of the reservoir 14 so as to deliver the liquid aerosol formulation from the reservoir to the heater 19. Preferably, the heater 19 is a heater coil formed of an electrically resistive material, such as a nickel-chromium alloy.

Preferably, the electronic smoking article 60 also includes at least one air inlet 40. The at least one air inlet 40 can be located upstream of the heater 19.

As shown in FIG. 2, the electronic smoking article 60 can further include the mouth-end insert 27 having at least two off-axis, preferably diverging outlets 21. Preferably, the mouth-end insert 27 includes at least two diverging outlets 21. (e.g. 3, 4, 5, or preferably 6 to 8 outlets or more). Preferably, the outlets 21 of the mouth-end insert 27 are located at ends of off-axis passages 23 and are angled outwardly in relation to the longitudinal direction of the electronic smoking article 60 (i.e., divergently). As used herein, the term "off-axis" denotes at an angle to the longitudinal direction of the electronic smoking article.

As shown in FIG. 2, the second section 72 includes the power supply 12, which can be a battery that is operable to apply voltage across the heater 19. The battery can be a Lithium-ion battery or one of its variants, for example a Lithium-ion polymer battery. Preferably, the power supply 12 is rechargeable and includes circuitry allowing the battery to be chargeable by an external charging device.

Figure 3:
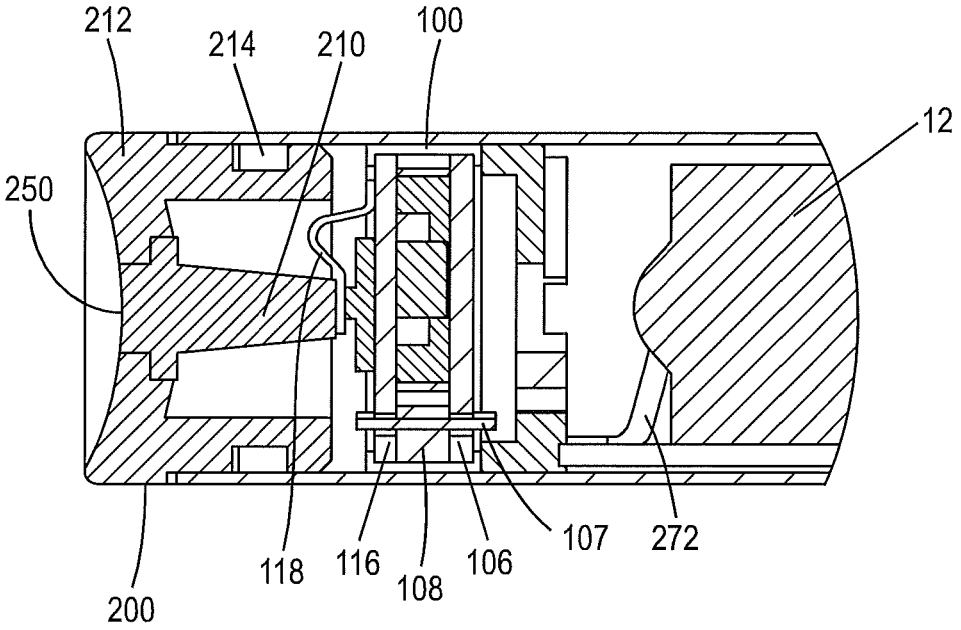
FIG. 3 is an enlarged view of an upstream end of the electronic smoking article of FIG. 2.
Figure 4:
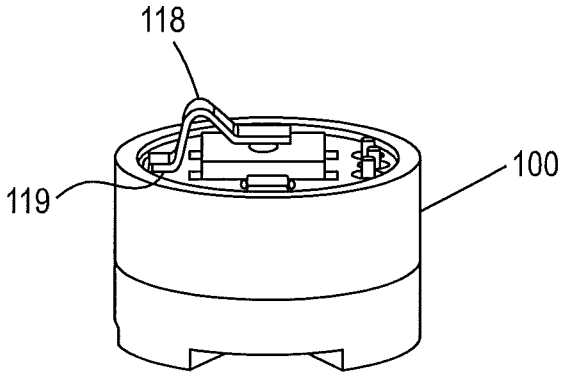
FIG. 4 is a perspective view of a puff sensor and feedback assembly as described herein.
Figure 6:
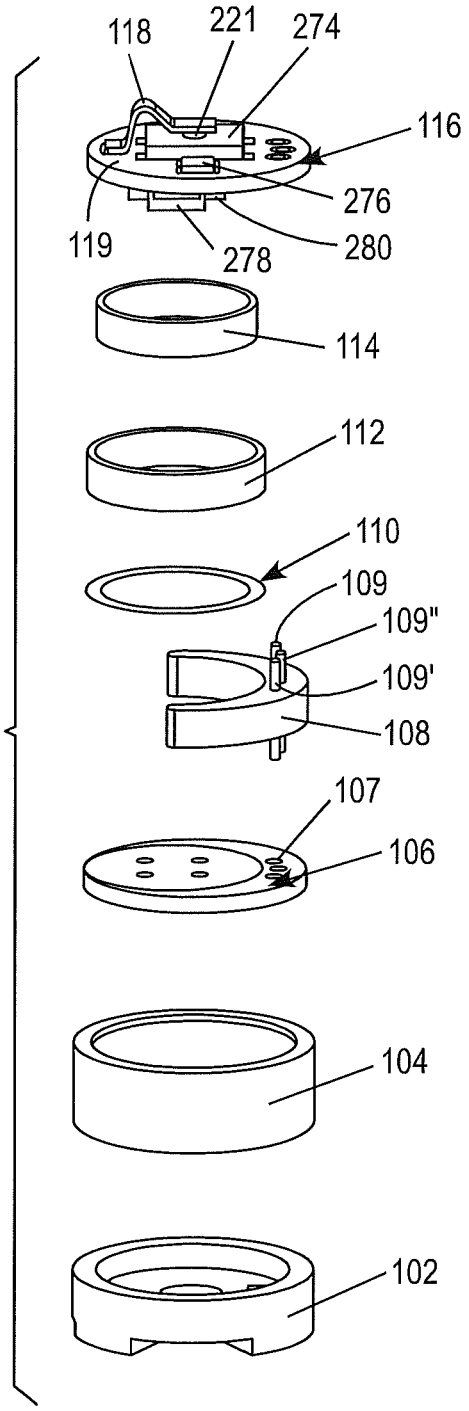
FIG. 6 is an exploded view of the puff sensor and feedback assembly of FIG. 4.

As shown in FIGS. 2 and 3, the second section 72 includes the puff sensor and feedback assembly 100 and the charging button assembly 200. A conductive post (button) 210 of the charging button assembly 200 forms the first, external electrical contact 250. A first electrical lead 270 extends from a first electrode (e.g., anode) of the power supply 12 and connects with an integrated circuit (or chip) 280 (shown in FIG. 6) in the puff sensor and feedback assembly 100 via one of three pins 109, 109', 109", which are described in detail below. A second electrical lead 272 extends from a second electrode (e.g., cathode) of the power supply 12 and connects with the integrated circuit 280 via a second one of the three pins 109'.

As shown in FIGS. 2, 3, 4 and 6, the puff sensor and feedback assembly 100 includes a gasket 102 and an external can 104, which house the remaining components of the puff sensor and feedback assembly 100. In a preferred embodiment, the gasket 102 is preferably formed of silicone and the external can 104 is formed of aluminium. It is contemplated that the gasket 102 can coextend with the external can 104 such that only the gasket 102 is in contact with an inner surface of the outer housing 22. Alternatively, a silicone or polymeric sleeve (not shown) can be positioned about the puff sensor and feedback assembly 100.

The puff sensor and feedback assembly 100 further includes a connection board 106 having three holes 107 in a periphery thereof operable to receive the pins 109, 109', 109". The three pins 109, 109', 109" extend through a C-shaped header and sensor locator 108 that is operable to maintain the pins 109, 109', 109" away from a puff sensor 114, which senses a puff during smoking (vaping). Moreover, use of the pins 109, 109', 109" facilitates electrical connections underneath the puff sensor and avoids any need to draw wires to the top surface of the puff sensor.

Figure 8:
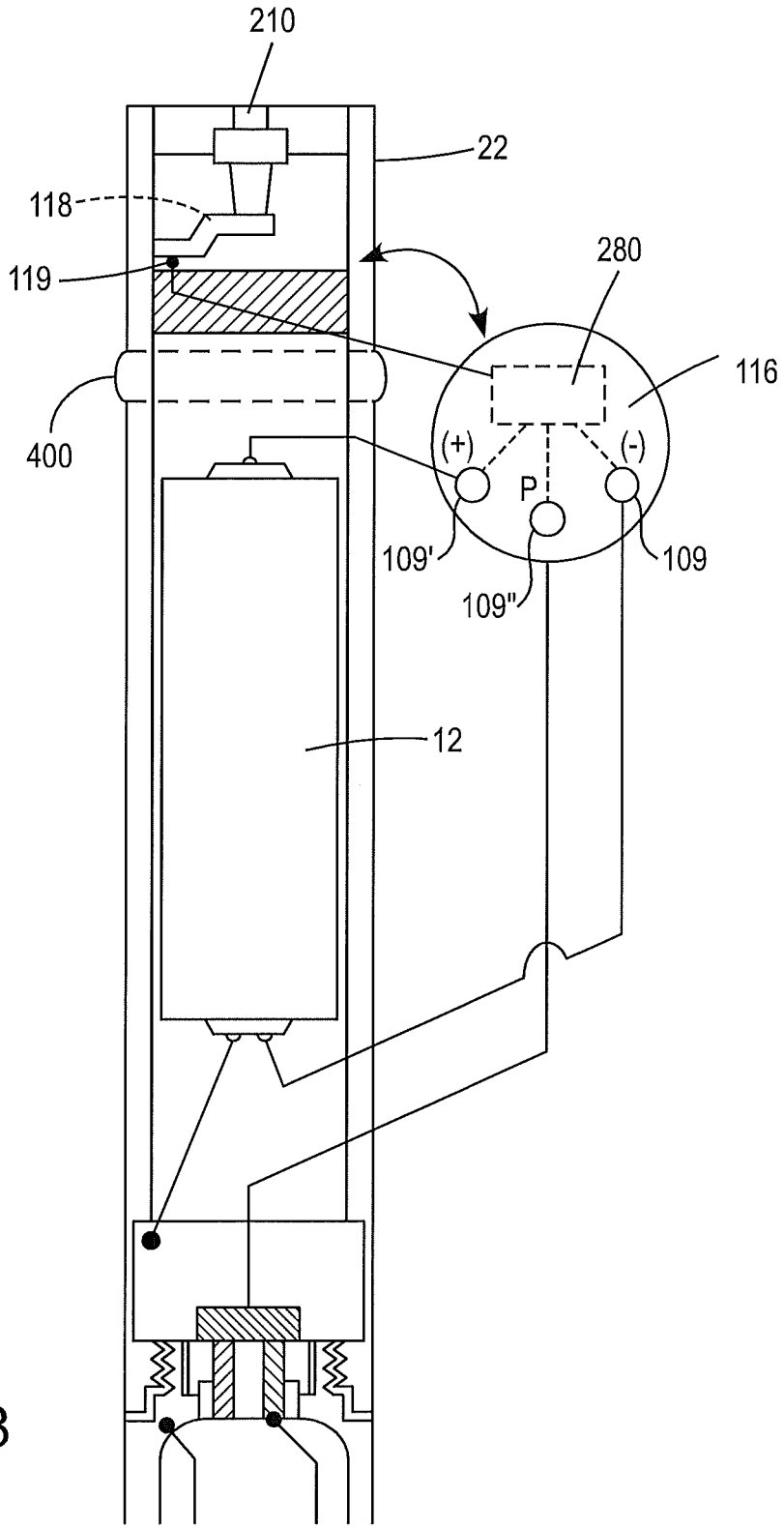
FIG. 8 is a diagrammatic representation of an exemplary electrical connection.

The puff sensor and feedback assembly 100 also includes a sensor insulating disk 110, a sensor insulating ring 112, and a feedback board 116. As shown in FIGS. 2 and 3, the feedback board 116 is positioned adjacent the charging button assembly 200. The feedback board 116 includes a connection spring 118, which is in electrical communication with one of the pins 109, 109' via a pad 119 (shown in FIGS. 8 and 9) and integrated circuit 280. The feedback board 116 also includes at least one LED 278, a capacitor 276, and three holes extending through the feedback board, which receive the pins 109, 109', 109".

The pins 109, 109', 109" provide electrical connections between the power supply 12 and the integrated circuit 280. As discussed above, the first pin 109 connects with the anode of the power supply and the second pin 109' connects with the cathode of the power supply. A third pin 109" provides a puff sensor out path. Moreover, the pins 109, 109', 109" simplify the wiring of the electronic smoking article 60 such that wires (electrical leads) extend only to the base of or beneath the puff sensor and feedback assembly 100.

Figure 5:
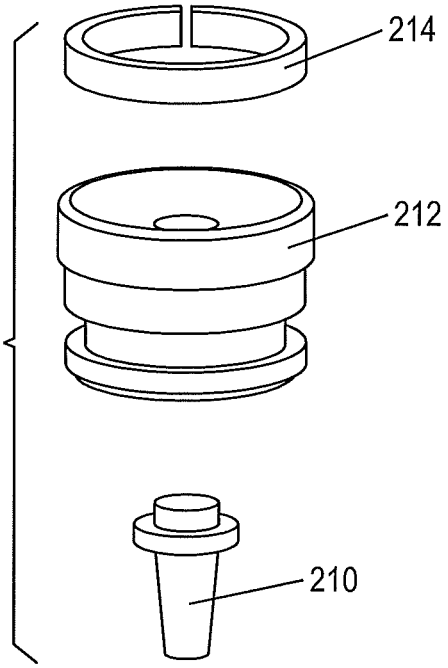
FIG. 5 is an exploded view of a charging button assembly as described herein.

As shown in FIGS. 2, 3 and 5, the charging button assembly 200 includes a charging button housing 212, a movable conductive post 210 held within the charging button housing 212, and a retaining ring 214. The conductive post 210 can be formed of steel or other suitable conductive material. Preferably, the retaining ring 214 is a spring that is operable to maintain the charging button assembly 200 within the upstream end 202 of the outer housing 22 when inserted therein.

Figure 7:
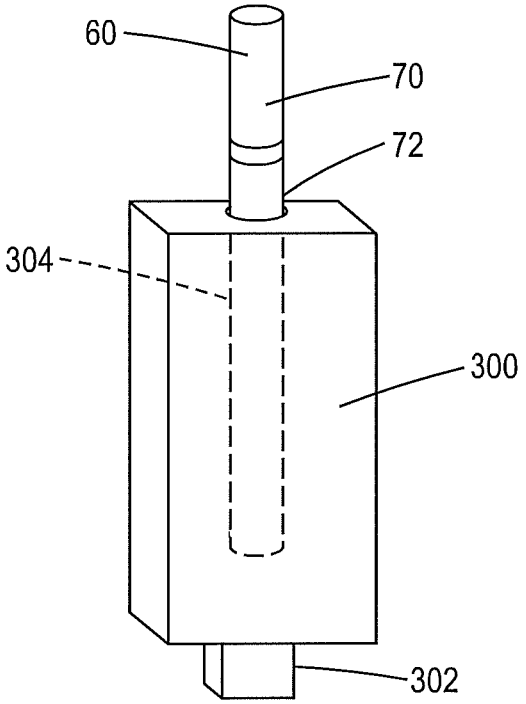
FIG. 7 is a perspective view of an exemplary charger for use with the electronic smoking article described herein.

To charge the electronic smoking article 60, the electronic smoking article 60 can be inserted, upstream end 202 first, into a charger 300 as shown in FIG. 7. A first electrical contact of the charger contacts the conductive post 210 (the first electrical contact 250) and a second electrical contact of the charger contacts the second electrical contact 252, which comprises an upstream surface portion of the outer housing 22 as described above. Once the electronic smoking article 60 is inserted into a charger, an electrical connection is formed and the power supply 12 of the electronic smoking article 12 is charged. Preferably, the first electrical contact 250 forms an electrical connection with the cathode of the power supply 12, while the second electrical contact 252 forms an electrical connection with the anode of the power supply 12. In another embodiment, the first electrical contact 250 can form an electrical connection the anode of the power supply 12, while the second electrical contact 252 forms an electrical connection with the cathode of the power supply 12.

The conductive post 210 is maintained in contact with and biased against the conductive connection spring 118, which is affixed and electrically connected at a circuit pad 119 on the board 116. The pad 119 is operatively connected with one of the pins 109, 109' under the control of a microprocessor or chip 280. The conductive spring 118 urges the conductive post 210 outwardly against the housing 212. In addition, the post 210 of charging button assembly 200 can be pressed against a button switch 221, which activates a control circuit that reads battery voltage and illuminates an LED array 278, including one or more LED's, in a manner indicative of the detected voltage so as to provide feedback regarding battery life and/or voltage use. The post 210 of the charging button assembly 200 need not be pressed to begin charging, and charging will occur without pressing the post 210. However, it is contemplated that charging can occur while the charging button assembly 200 is pressed if desired.

Figure 9:
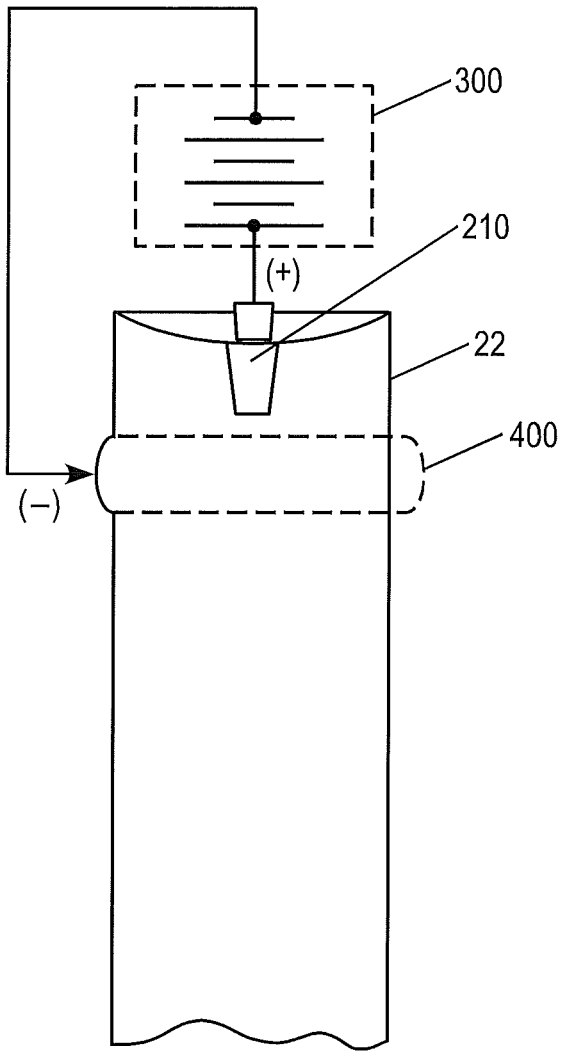
FIG. 9 is a diagrammatic representation of an exemplary electrical connection.

As shown in FIGS. 9 and 10, the electronic smoking article 60 can optionally include a conductive band 400 which acts as the second, external contact 252. This band 400 can be an exposed or unpainted portion of a metal outer housing 22. If the integrated circuit 280 (or chip) reads current from the pad 119, a circuit connection is established through the chip 280 between the charger via contacts 250 and 252 (400) and the terminals of the battery 12 wherein the chip 280 will charge the power supply 12 by adjusting current to achieve a target voltage.

The charger 300 can include a well 304 operable to receive at least the upstream end portion of the electronic smoking article 60. Once inserted, a first electrical contact and a second electrical contact engage with the button charging contact 210 and the second electrical contact 252 on the outer housing 22. The charger 300 can include a USB connection 302 or other suitable connection. The USB connection 302 can be retracted into the body of the charger 300, if desired.

In a preferred embodiment, the electronic smoking article 60 is about the same size as a conventional smoking article. In some embodiments, the electronic smoking article 60 can be about 80 mm to about 110 mm long, preferably about 80 mm to about 100 mm long and about 7 mm to about 8 mm in diameter or greater. For example, in an embodiment, the electronic smoking article is about 84 mm long and has a diameter of about 7.8 mm.

The outer cylindrical housing 22 of the electronic smoking article 60 may be formed of any suitable material or combination of materials. Preferably, the outer cylindrical housing 22 is formed of metal and is part of the electrical circuit.

Preferably, the liquid aerosol formulation for use in each of the electronic smoking articles 60 described herein includes at least one aerosol former, optionally water, and flavors. The liquid aerosol formulation can include nicotine or be nicotine free. Moreover, the liquid aerosol formulation can include tobacco flavors or other suitable flavors.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

The invention claimed is:

1. An electronic vaping article comprising:

an outer housing configured to hold a liquid formulation, the outer housing including an upstream end and a downstream end;

a heater in fluidic communication with the liquid formulation;

a power supply configured to apply a voltage across the heater;

a first electrical contact and a second electrical contact electrically connected to the power supply, the power supply configured to be charged via the first electrical contact and the second electrical contact, the first electrical contact being biased outward relative to the power supply; and a sensor and feedback assembly including a connection spring, a feedback board, a C-shaped locator structure, and a connection board, the connection spring configured to bias the first electrical contact.

2. The electronic vaping article of claim 1, wherein the outer housing has a longitudinal axis, and the first electrical contact is movable along the longitudinal axis.

3. The electronic vaping article of claim 1, wherein the first electrical contact and the second electrical contact are at the upstream end of the outer housing.

4. The electronic vaping article of claim 3, wherein the first electrical contact is farther from the downstream end than the second electrical contact.

5. The electronic vaping article of claim 1, wherein the first electrical contact includes an exposed portion and a hidden portion, the exposed portion being visible based on an external view, the hidden portion being concealed based on the external view, the exposed portion of the first electrical contact being part of an exterior surface of the electronic vaping article.

6. The electronic vaping article of claim 5, wherein the exposed portion of the first electrical contact conforms with a contour of an adjacent section of the exterior surface of the electronic vaping article.

7. The electronic vaping article of claim 1, wherein the first electrical contact is in a form of a conductive post.

8. The electronic vaping article of claim 1, wherein the second electrical contact is in a form of a conductive band.

9. The electronic vaping article of claim 1, wherein the first electrical contact is at a center of an end face of the outer housing, and the second electrical contact is on a side wall of the outer housing.

10. The electronic vaping article of claim 1, further comprising:

a charging button assembly including a charging button housing and the first electrical contact.

11. The electronic vaping article of claim 10, wherein the charging button housing defines a through hole configured to receive the first electrical contact.

12. The electronic vaping article of claim 11, wherein the charging button assembly further includes a retaining ring seated within an annular groove of the charging button housing, the retaining ring configured to engage with an interior surface of the outer housing.

13. The electronic vaping article of claim 1, wherein the connection spring is configured to bias the first electrical contact away from the power supply.

14. The electronic vaping article of claim 1, wherein the sensor and feedback assembly further includes a plurality of pins extending through the feedback board, the C-shaped locator structure, and the connection board.

15. The electronic vaping article of claim 14, wherein the plurality of pins include a first pin and a second pin, the first pin and the second pin electrically connected to the power supply.

16. The electronic vaping article of claim 15, wherein the plurality of pins further include a third pin electrically connected to the connection spring.

17. The electronic vaping article of claim 1, further comprising:

a light emitting diode configured to illuminate when the first electrical contact is pushed inward relative to the power supply.

18. The electronic vaping article of claim 1, further comprising:

a mouth-end insert at the downstream end of the outer housing, the mouth-end insert defining diverging outlets.

* * * * *